US005131348A

United States Patent [19]

Roy

[11] Patent Number: 5,131,348

[45] Date of Patent: Jul. 21, 1992

[54] COMPOSITE HULL BOAT WITH RIGID BOTTOM AND INFLATABLE TUBULAR BUOYANCY ELEMENT

[75] Inventor: Philippe Roy, Saint Agnant, France

[73] Assignee: Zodiac International, Issy-les-Moulineaux, France

[21] Appl. No.: 725,056

[22] Filed: Jul. 8, 1991

[30] Foreign Application Priority Data

Jul. 6, 1990 [FR] France ..... 90 98610

[51] Int. Cl.[5] ..... B63B 35/86

[52] U.S. Cl. ..... 114/363; 114/345

[58] Field of Search ..... 114/345, 363, 343, 354, 114/357, 355, 270

[56] References Cited

U.S. PATENT DOCUMENTS 4,945,852 8/1990 Kobayashi ..... 114/363

FOREIGN PATENT DOCUMENTS 0274359 7/1988 European Pat. Off. ..... 114/345

2168932 7/1986 United Kingdom ..... 114/345

*Primary Examiner*—Edwin L. Swinehart

*Attorney, Agent, or Firm*—Larson & Taylor

[57] ABSTRACT

A boat is disclosed including a composite hull with a rigid bottom (2) and an inflatable tubular buoyancy element (3) having a general U shape fixed to the upper edge of the bottom along the front and lateral sides thereof, the bottom having at the rear an upstanding wall forming an upper stern (4), a rigid deck (5) being further fixed to the bottom and defining therewith a housing (6) for an on-board drive and propellant device, in which the deck (5) forms, in its rear half, an upwardly projecting axial T shaped console (9), the transverse bar of the T forming a transverse seat (10) and the leg of the T forming successively (from the rear forwards) a jockey seat (11) for the pilot and a block, which is raised with respect thereto, forming a piloting post (12) situated immediately behind the seat (10), the rear end of the leg of the T being connected to the upper stern (4); the portion of the deck situated on each side of the jockey seat forms a floor (13) for the pilot; and the drive and propellant device are situated substantially under the T shaped console (9).

9 Claims, 3 Drawing Sheets

COMPOSITE HULL BOAT WITH RIGID BOTTOM AND INFLATABLE TUBULAR BUOYANCY ELEMENT

The present invention relates generally to composite hull boats and more generally it relates to composite hull boats with a rigid bottom and an inflatable buoyancy tube having a general U shape fixed to the upper edge of the bottom along the front and lateral sides thereof, the bottom having at the rear an upstanding wall forming the upper stern, a rigid deck being further fixed to the bottom and defining therewith a housing for drive and propellant means.

Different embodiments are known of such composite hull boats which are adapted to be equipped with outboard motors generally with propellers and to receive different equipment appropriate to the anticipated uses. It is in particular possible to equip them by fixing, to the deck, a central pylon forming a piloting post, a jockey seat for the pilot incorporated or not in the central pylon, a seat for the passengers, storage chests etc. . . .

Although this modular design is interesting because of the facilities it provides for adapting to multiple needs and particular requirements of the users from a common base and because of the lowering of costs which results therefrom, it is nevertheless true that such a boat, even equipped accordingly (piloting post, jockey seat) keeps a hybrid appearance and does not have the resolutely sporty and competitive appearance which is desired by some.

The object of the invention is then essentially to overcome this drawback and to provide a composite hull boat arrangement which, while keeping the known advantages of the traditional composite hull, has a more sporty appearance than the modular adaptations produced at present, such a boat adapted in accordance with the invention further giving rise to certain technical constructions which communicate thereto more sporty sailing characteristics than those of traditional boats of the same type.

To these ends, a boat of the type mentioned in the preamble, adapted in accordance with the invention, is essentially characterized:

in that the deck forms, approximately in its rear half, an upwardly projecting console having, seen from above, a general approximately T shape extending axially, the transverse bar of the T forming a transverse seat located approximately in the longitudinal middle of the boat, the leg of the T forming successively (from the rear forwards) a jockey seat for the pilot and a block, which is raised with respect thereto, forming a piloting post situated immediately behind the transverse bar of the T forming the transverse seat, the rear end of the leg of the T which forms the jockey seat being connected to the upper stern, in that the portion of the deck situated on each side of the jockey seat forms a floor for the pilot, and in that the drive and propellant means are situated substantially under the T shaped console.

Thus, an arrangement such as that adopted in accordance with the invention keeps a one-piece deck structure which, by rigid assembly with the bottom, leads to a particularly strong assembly which may, from the mechanical strength point of view, confront the waves and without the risk of damage be subjected to considerable forces resulting from high speed sporting piloting at sea.

Furthermore, the console equipment part, in a single piece, may be formed and shaped homogeneously so as to confer on the unit a sporting line, which the added modular elements used up to now did not permit.

Finally, the general T shaped console is disposed in the boat in a position, and it defines an inner free volume, such that it is quite possible to house therein drive means, a transmission shaft and propellant means replacing the traditional outboard motor.

It is in particular possible to install water jet propulsion means, which are also disposed integrally on board and whose water ejection orifice forming a propellant means opens at the lower part of the upper stern.

In this case, to benefit from all the advantages conferred by such motorization and in order to increase the sporting driving possibilities of the boat, it is desirable for the bottom to have an approximately V cross section in its front part and a cross section having approximately a V shape with truncated point in its rear part in which a central longitudinal surface is thus defined which is substantially flat in the form of a ski.

Furthermore, in so far as the arrangement of the deck is concerned, it is advantageous for the deck to be lowered, in front of the cross bar of the T, approximately as far as the bottom and to extend to the front of the boat while defining a recess; in this case, it is preferable to provide a floor for covering said front portion of the deck forming a recess so as to define therewith at least one compartment which is isolated from the compartment housing the drive and propellant means; thus, the compartment, or one of these compartments, may house the fuel reserve which is thus physically separated from the motor for increasing safety.

In an interesting embodiment, the front floor is formed with two levels, the intermediate floor portion situated immediately in front of the transverse seat being located at a level substantially lower than that of the tapered floor portion of the boat and these two floor portions being joined together by an abrupt transverse shoulder able to form a support in the longitudinal direction for the feet of the users of the transverse seat; thus, the front floor may comprise two trap-doors giving access to two corresponding underlying compartments defined in the recess, these two trap-doors being situated respectively in the two intermediate and tapered floor portions.

To facilitate maintenance of the mechanical part of the boat, the top of the jockey seat and the upper part of the block forming the piloting post are advantageously removable and/or pivotable so as to give access to the underlying drive and propellant means and, preferably, they can be removed and/or raised independently of each other.

The invention will be better understood from the following detailed description of a preferred embodiment given solely by way of purely illustrative example. In this description, reference is made to the accompanying drawings in which.

Figure 1:
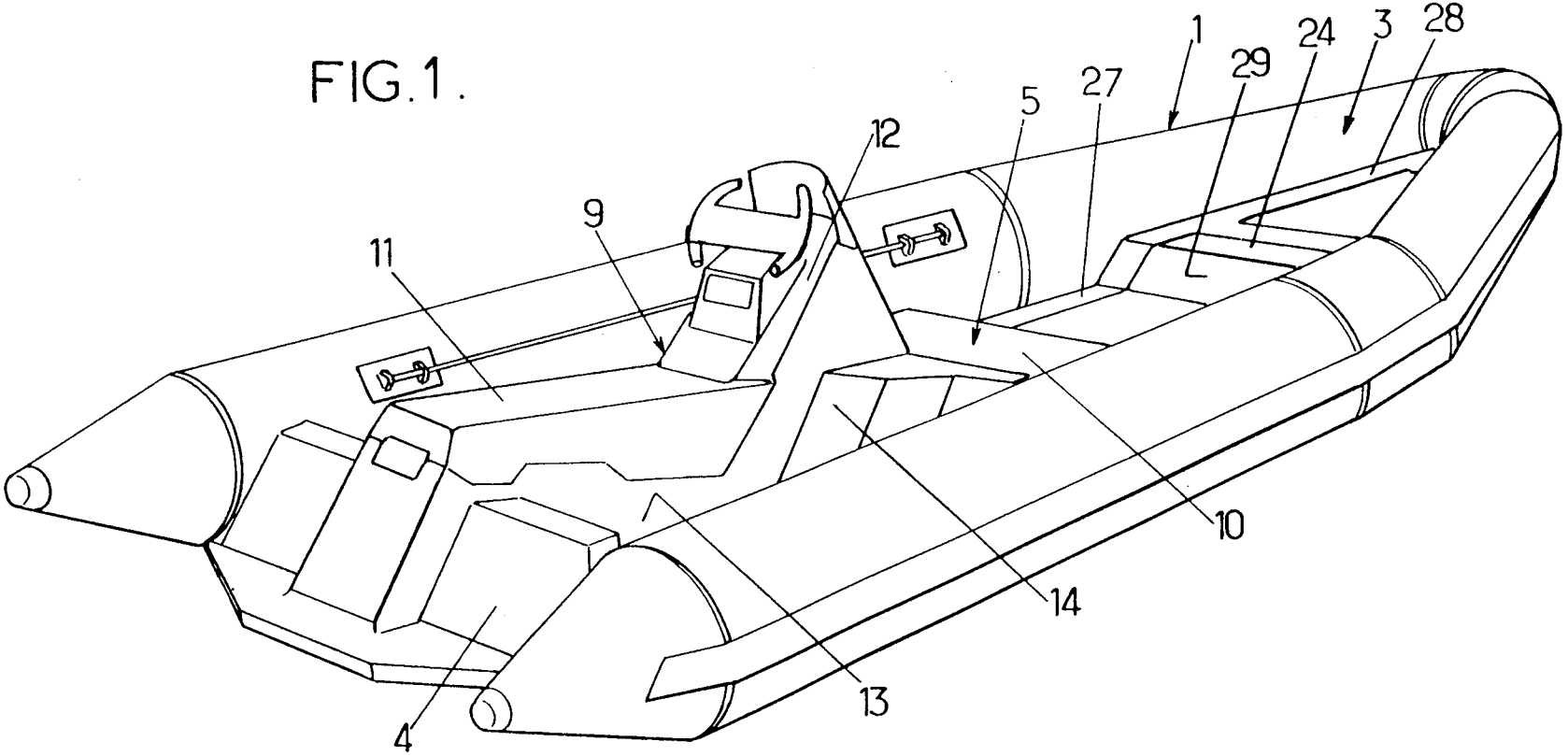
FIG. 1 is a perspective view of a composite hull boat constructed in accordance with the invention.
Figure 2:
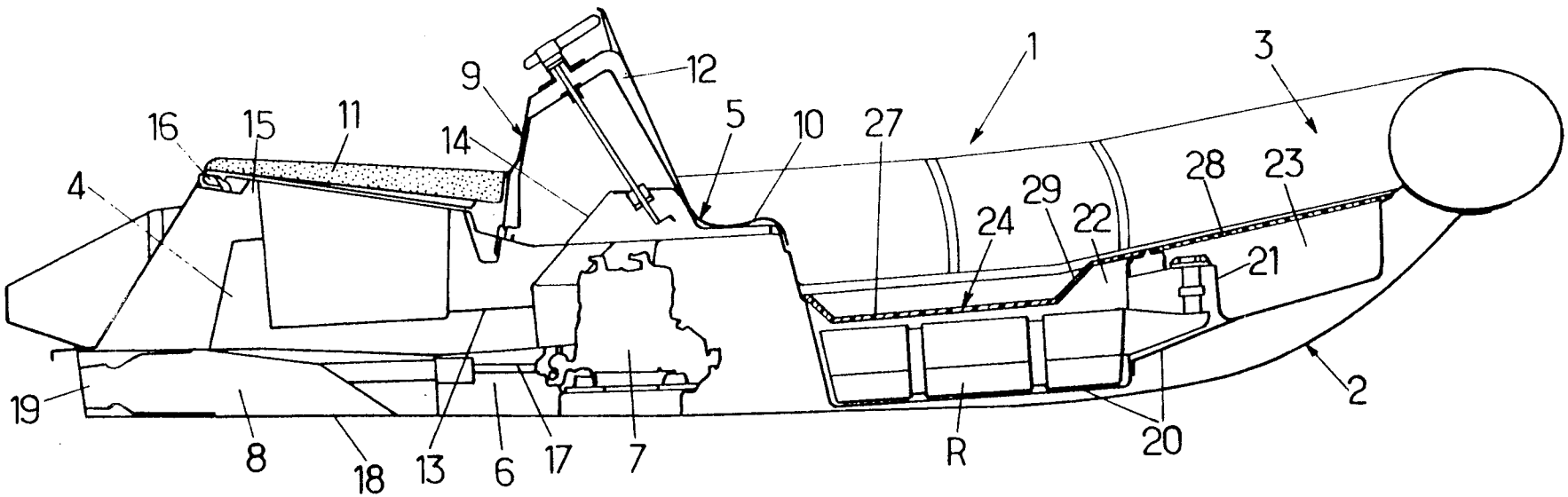
FIG. 2 is a longitudinal cross sectional view of the boat of FIG. 1.
Figure 3:
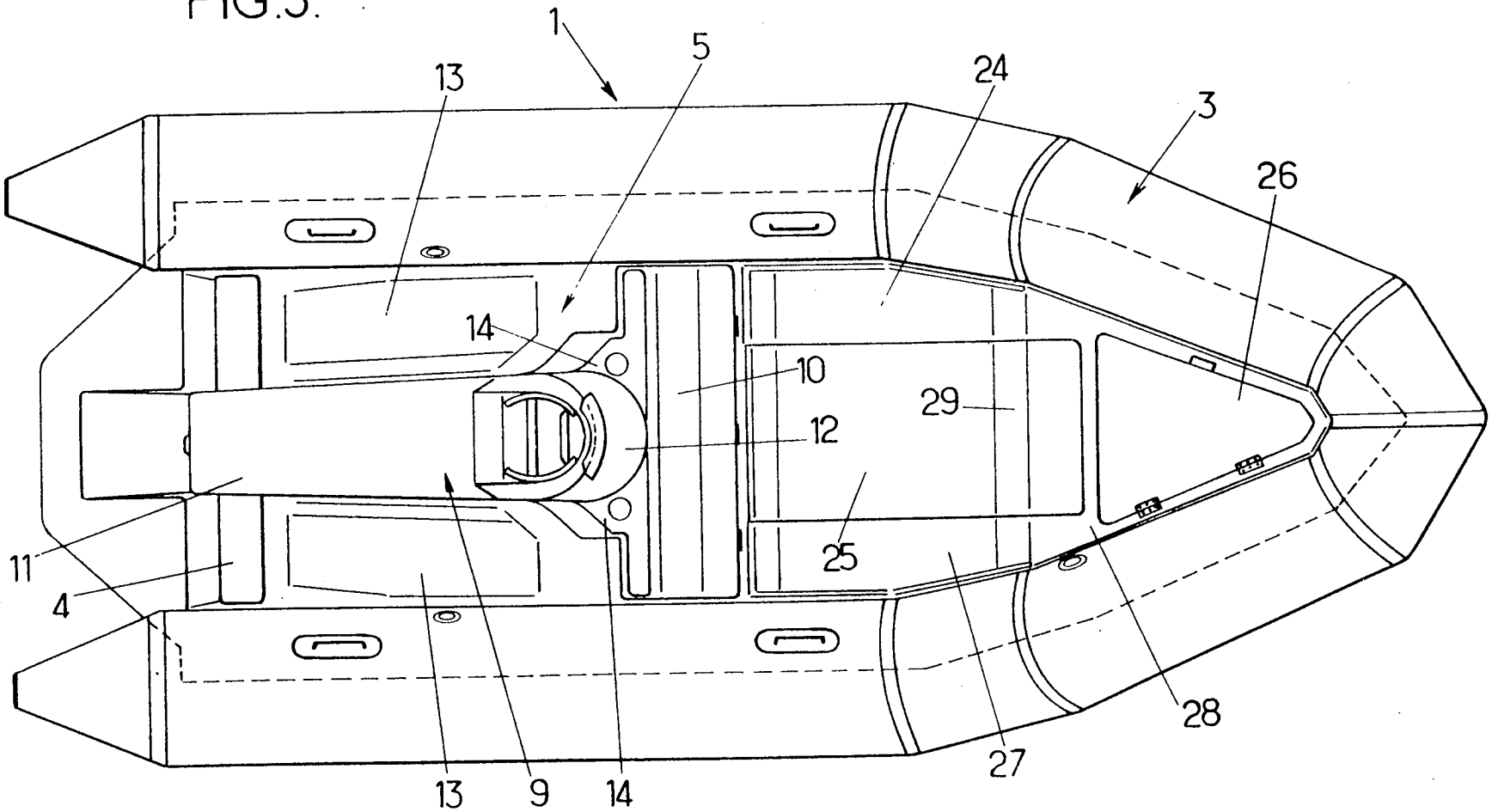
FIG. 3 is a top view of the boat of FIG. 1.

The boat shown in FIGS. 1 to 3 and designated as a whole by the general reference 1 comprises a composite hull with a rigid bottom 2 and an inflatable buoyancy tube 3, having the general form of a U, which is fixed to the upper edge of the bottom along the front and lateral sides thereof. The bottom, whose specific profile, advantageous for the use anticipated for the boat, will be described further on, has at the rear an upwardly erected wall forming the upper stern 4 of the boat; as shown, the upper stern 4 may be slightly slanted, or at least have a rear face slanted slightly from the front rearwards so as to be inscribed in an aesthetic overall line conferred on the boat.

Furthermore, a rigid deck 5 is fixed to bottom 2 and defines therewith, as will be explained further on, a housing 6 for the drive 7 and propellant 8 means.

The rigid deck 5 extends over the whole of the boat and it has, approximately in its rear half, an upwardly projecting console 9 which has, seen from the top, the general approximate shape of a T. The transverse bar of the T, situated approximately in the longitudinal middle of the boat, forms a transverse seat 10 for passengers. The leg of the T forms successively, from the rear forwards, a jockey seat 11 for the pilot (and possibly a passenger) and a block 12 which is raised with respect to seat 11 and forms a piloting post which is located just at the rear of the transverse seat 10.

The leg of the T extends above, even beyond the upper stern, and straddles it.

On each side of the jockey seat 11, the deck forms respectively two platforms 13 for the feet of the pilot, whereas, on each side of the block 12 forming the piloting post, two lateral projections 14 are provided respectively serving towards the front as seatback for the transverse seat 10 and towards the rear as support surfaces for the knees of the pilot.

The top 15 of the jockey seat 11 is removable, or can at least be raised, for example rearwards by pivoting about a hinge 16, as shown in FIG. 2; similarly, the upper part of block 12 is removable (as shown) or at least can be raised by pivoting.

The arrangement which has just been described frees, between the bottom and the deck, a housing 6 defined upwards by the console 9, the considerable free volume of which housing can contain the whole of the mechanics and the controls of the boat. As shown in FIG. 2, the drive means 7 are situated in line with block 12 and are joined by a transmission shaft 17 to the propellant means 8 which extend approximately into the jockey seat 11. Access to the drive and propellant means, for example for maintenance purposes, is achieved by raising or pivoting the top of seat 15 and the upper part of block 12.

Thus, a boat can be produced whose drive and propellant means are situated integrally on board, inside the hull, and are disposed appropriately for a good longitudinal distribution of the masses. This arrangement is independent of the type of propulsion adopted and is therefore particularly suitable for water jet propulsion: the water inlet grid is shown at 18 and the water ejection orifice 19 opens into the lower part of the upper stern.

In front of console 9, deck 5 is lowered (at 20 in FIG. 2) approximately as far as the level of the rigid floor 2 and then extends to the front end of the bottom, thus defining with the latter a recess which may, for example, be subdivided by a partition 21 into two compartments 22 and 23 as shown. Above this recess a floor 24 may be provided having two trap-doors 25, 26 for access to the compartments 22, 23 respectively. Thus, at least one compartment (22 for example) is formed for receiving a fuel reservoir R which, by the special configuration of floor 5, is isolated from the housing 6 containing the drive means 7.

In its portion 27 situated immediately in front of transverse seat 10 (and including the trap-door 25), floor 24 is at a level lower than that of portion 28 which is situated at the front end (tapered portion, including trap-door 26), which may be slanted so as to follow the longitudinal profile of the bottom. The two floor portions 27 and 28 are joined together by an abrupt connecting surface or shoulder 29, vertical or highly slanted, which forms a longitudinal retaining support for the feet of the passengers sitting on the transverse seat 10.

To confer on the boat a better aptitude to sporting driving than that offered by composite hull boats with V shaped bottom known at present, the bottom has a V shaped cross section solely in its front part and in its rear part it has a cross section in the form of a V with a truncated apex: this truncated V cross section defines, at the lower part of the bottom, a central external longitudinal surface which is substantially flat, in the general form of a ski.

With the arrangements of the invention, a boat is formed in three main parts: rigid bottom, inflatable tubular elements and rigid deck, which can be prefabricated and readily assembled; such a boat may be given a specific aesthetic appearance, allows the on board installation of the whole of the drive and propellant means, has a rigidity appropriate to the type of piloting for which it is designed and keeps the advantages of buoyancy, unsinkability and safety inherent in composite structure hulls.

What is claimed is:

1. A boat comprising:

a composite hull including a rigid longitudinal bottom having an upper edge, a front, lateral sides, a rear, a longitudinal middle, and an upstanding wall forming an upper stern, and an inflatable tubular buoyancy element having a general U shape which is fixed to said upper edge of said bottom along said front and said lateral sides;

a rigid deck which is fixed to said bottom and defining with said bottom a housing therebetween, said deck including a rearward portion, an upwardly projecting console in said rearward portion having a general T shape in plan view, said T shaped console having (a) a transverse seat forming a transverse bar of the T shape, said transverse seat extending laterally between said lateral sides and being located adjacent said longitudinal middle of said bottom and (b) a leg portion forming a leg of the T shape, said leg portion extending longitudinally of said bottom and rearwardly from said transverse seat, said leg portion including (i) a jockey seat for the pilot, (ii) a block forming a piloting post situated immediately behind said transverse seat and forward of said jockey seat, said block being raised with respect to said jockey seat, and (iii) a rear end located behind said jockey seat and connected to said upper stern, and a rear floor portion on each side of said jockey seat which forms a rear floor for the pilot sitting on said jockey seat; and an on board drive means for driving said boat and a propellant means for propelling said boat, both said drive means and said propellant means being situated under said T shaped console.

2. A boat as claimed in claim 1 wherein said deck further includes a forward portion which is closely adjacent to said bottom and a cover for said forward portion forming a recess, said recess extending vertically between said forward portion and said cover and longitudinally from said transverse seat to said front of said bottom.

3. A boat as claimed in claim 2 wherein said cover of said forward portion of said deck includes a forward floor which covers said recess and which forms at least one compartment isolated from said drive and propellant means under said T shaped console.

4. A boat as claimed in claim 3 wherein said forward floor includes an intermediate floor portion immediately in front of said transverse seat, a tapered floor portion in front of said intermediate floor portion and at a level substantially higher than said intermediate floor portion, and an abrupt transverse shoulder which connects said intermediate floor portion to said tapered floor portion and which forms a support for feet of users sitting on said transverse seat.

5. A boat as claimed in claim 4 wherein said intermediate floor portion includes a first trap door therein and a first underlying compartment in said recess, and wherein said tapered floor portion includes a second trap door therein and a second underlying compartment in said recess.

6. A boat as claimed in claim 3 wherein said forward floor includes two trap doors and respective compartments underlying respective said trap doors in said recess.

7. A boat as claimed in claim 1 wherein said jockey seat includes a top, wherein said block includes an upper part, and wherein said top and said upper part are movable relative to a remainder of said T shaped console.

8. A boat as claimed in claim 7 wherein said top and said upper part are movable independently of each other.

9. A boat as claimed in claim 1 wherein said propellant means is a water jet propellant means.

* * * * *